US009126426B2

(12) United States Patent
Maeda

(10) Patent No.: US 9,126,426 B2
(45) Date of Patent: Sep. 8, 2015

(54) TRANSFER CONTROL METHOD OF CONTINUOUS PAPER AND PRINTER

(71) Applicant: Seiko Epson Corporation, Tokyo (JP)

(72) Inventor: Hiroyuki Maeda, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/959,950

(22) Filed: Aug. 6, 2013

(65) Prior Publication Data

US 2014/0043387 A1 Feb. 13, 2014

(30) Foreign Application Priority Data

Aug. 8, 2012 (JP) ..... 2012-175755

(51) Int. Cl.

| | |
|---|---|
| ***B41J 29/38*** | (2006.01) |
| ***B41J 2/01*** | (2006.01) |
| ***B41J 13/00*** | (2006.01) |
| ***B41J 11/26*** | (2006.01) |
| ***B41J 11/42*** | (2006.01) |
| ***B41J 15/04*** | (2006.01) |

(52) U.S. Cl.

CPC ..... *B41J 13/0009* (2013.01); *B41J 11/26* (2013.01); *B41J 11/42* (2013.01); *B41J 15/04* (2013.01)

(58) Field of Classification Search

CPC ..... B41J 11/007; B41J 11/42; B41J 15/00
USPC ..... 347/16, 101, 104–105
See application file for complete search history.

(56) References Cited

U.S. PATENT DOCUMENTS

| | | | | |
|---|---|---|---|---|
| 2011/0200378 | A1 | 8/2011 | Moriyama | |
| 2012/0062675 | A1* | 3/2012 | Kawakami | 347/104 |
| 2013/0044151 | A1* | 2/2013 | Masuda et al. | 347/16 |

FOREIGN PATENT DOCUMENTS

| | | | | |
|---|---|---|---|---|
| JP | 58-142877 | A | | 8/1983 |
| JP | 05-116394 | A | | 5/1993 |
| JP | 2011-168365 | A | | 9/2011 |
| JP | 2011168365 | A | * | 9/2011 |
| JP | 2012-045876 | A | | 3/2012 |

* cited by examiner

*Primary Examiner* — Jason Uhlenhake
(74) *Attorney, Agent, or Firm* — Nutter McClennen & Fish LLP; John J. Penny, Jr.

(57) ABSTRACT

A transfer control method of continuous paper includes controlling a transfer amount of the continuous paper based on a rotational amount detected by a roller feeding amount detecting unit which detects the rotational amount of a paper feed roller, when each page of the continuous paper is printed, and when the printing on each page is completed, performing a cueing process of transferring the continuous paper until a printing start position of a next page reaches the printing position. The cueing process includes transferring the continuous paper until the continuous paper reaches a reference transfer position based on the feeding amount of the tractor detected by a tractor feeding amount detecting unit for detecting a feeding amount of the tractor and after the continuous paper reaches the reference transfer position, setting the transfer amount of the continuous paper as a target feeding amount.

13 Claims, 4 Drawing Sheets

TRANSFER CONTROL METHOD OF CONTINUOUS PAPER AND PRINTER

The disclosure of Japanese Patent Application No. 2012-175755 filed on Aug. 8, 2012, including specification, drawings and claims is incorporated herein by reference in its entirety.

BACKGROUND

1. Technical Field

An aspect of the present disclosure relates to a printer employing a paper feed roller and a tractor as a transfer mechanism for transferring continuous paper, and more particularly, to a transfer control method of continuous paper and a printer which transfers the continuous paper with high precision.

2. Related Art

Heretofore, in printers capable of printing continuous paper with sprocket holes (engagement holes) formed on both ends thereof, a tractor and a paper feed roller are used as a transfer mechanism for transferring the continuous paper. The tractor includes tractor pins (engagement portions) which can be inserted into the sprocket holes formed along a longitudinal direction of the continuous paper, a tractor belt with the tractor pins formed on its outer circumference at certain intervals, and a drive sprocket and a driven sprocket with the tractor belt mounted therebetween. The paper feed roller is disposed between a printing position and the tractor.

A printer including a tractor and a paper feed roller is disclosed in JP-A-2011-168365. The printer disclosed in JP-A-2011-168365 transfers the continuous paper by use of the tractor as a main feed unit until a leading end of the continuous paper fed from the tractor side is delivered to the paper feed roller, and the paper feed roller as the main feed unit after the continuous paper is delivered to the paper feed roller. Using the paper feed roller as the main feed unit during printing is preferable to the high precise printing.

Further, the printer disclosed in JP-A-2011-168365 controls a transfer amount of the continuous paper by detecting a rotational amount of the paper feed roller when the paper feed roller is used as the main feed roller. If the continuous paper slips on the paper feed roller due to the increased transfer load of the continuous paper, the actual feeding amount is decreased relative to the actual feeding amount (set feeding amount) which can be calculated from the rotational amount of the paper feed roller, which creates a transfer error. Accordingly, in the printer disclosed in JP-A-2011-168365, the actual feeding amount of the continuous paper is calculated by detecting a driven amount of the tractor whenever the printing corresponding to one page is performed, and a difference between the calculated set feeding amount and the calculated actual feeding amount is calculated from the rotational amount of the paper feed roller. When the continuous paper is fed to a next page, the set feeding amount is compensated by the amount to eliminate the difference, and the rotational amount of the paper feed roller is controlled according to a compensation value.

As described in the printer disclosed in JPA-2011-168365, the transfer control method can realize the high precise printing, since the paper feed roller is used as the main feed roller during printing. Further, the transfer precision can be improved, since the feeding amount to feed the paper to the next page is compensated to eliminate the transfer error created during printing. However, the transfer control method does not consider the transfer error in a transfer section, but consider the transfer error during printing. For this reason, after the printing is completed, it is not possible to eliminate the transfer error which is created when the paper is fed to the next page. Further, since it is not possible to prevent accumulation in the transfer errors, a printing start position shift may be increased at a next page in a case where the transfer amount is high due to the many number of pages.

SUMMARY

An aspect of the present disclosure has been made in view of the above circumstances, and an advantage of some aspect of the disclosure is to provide a printer capable of having a good balance between high precise printing using transfer precision of a paper feed roller and prevention of accumulation in transfer errors.

According to an aspect of the disclosure, a transfer control method of continuous paper in a printer including a tractor having a sequential engagement portion which is engaged with engagement holes formed along a longitudinal direction of the continuous paper in which page dividing positions are set at regular intervals, and a paper feed roller provided at a downstream side in a transfer direction of the tractor, the printer transferring the continuous paper using the paper feed roller and the tractor through a printing position of a printing head, the transfer control method includes controlling a transfer amount of the continuous paper based on a rotational amount detected by a roller feeding amount detecting unit which detects the rotational amount of the paper feed roller, when each page of the continuous paper is printed, and when the printing on each page is completed, performing a cueing process of transferring the continuous paper until a printing start position of a next page reaches the printing position. The cueing process includes transferring the continuous paper until the continuous paper reaches a reference transfer position at which a distance between the printing start position of the next page and the printing position is equal to a reference dimension based on the feeding amount of the tractor detected by a tractor feeding amount detecting unit for detecting a feeding amount of the tractor, and after the continuous paper reaches the reference transfer position, setting the transfer amount of the continuous paper with which the printing start position of the next page reaches the printing position from the reference transfer position as a target feeding amount.

As described above, an aspect of the disclosure performs the high precise printing by transferring the continuous paper with the transfer precision of the paper feed roller during printing of each page, based on the detected value from the roller feeding amount detecting unit. Meanwhile, in the cueing process of positioning the printing start position of the next page at the printing position, the continuous paper is transferred to the preset reference transfer position using the detected value from the tractor feeding amount detecting unit, and at this point, the transfer amount of the continuous paper in the remaining transfer section is reset as the target feeding amount. The tractor feeding amount detecting unit can accurately detect a feeding amount of the engagement portion which moves by physical engagement with the engagement hole. There may be an error within a play range between the engagement hole and the engagement portion, but a transfer error is not accumulated even though the transfer amount is increased. Accordingly, by performing such a control in the example, the accurate target feeding amount can be set at the point for the remaining transfer section when the printing start position of the next page is sufficiently close to the printing position. Therefore, since the printing start position shift can be reduced, it is possible to prevent the accumulation in the transfer error occurring at each page. In addition, according to the method, it is not necessary to perform a complicated process, such as a process of calculating a transfer error and compensating the transfer amount, and it is preferable to detect the reach of the continuous paper to the preset reference transfer position using the tractor feeding amount detecting unit, and to set the target transfer amount from that point as the determined value. Accordingly, the control is easy.

In an aspect of the disclosure, the transfer of the set target feeding amount is controlled based on a detected value from the tractor feeding amount detecting unit. In this way, the transfer error caused by the slip of the paper feed roller in the remaining transfer section is not added.

Alternatively, in an aspect of the disclosure, the transfer of the set target feeding amount may be controlled based on a detected value from the roller feeding amount detecting unit. In this way, it is possible to perform the transfer in the remaining transfer section with the feed precision of the paper feed roller. Further, in this instance, it is preferable that after the transfer of the continuous paper in the remaining transfer section is performed based on the set target feeding amount, the actual feeding amount of the continuous paper in the remaining transfer section is calculated based on the detected value from the tractor feeding amount detecting unit, and a difference between the actual feeding amount and the target feeding amount is calculated, and in a next cueing process, the target feeding amount is compensated to eliminate the difference. In this way, since a slight transfer error occurring in the remaining transfer section can be figured out, and then be eliminated at the next page, it is possible to reduce the transfer error in the remaining transfer section, and to prevent the accumulation thereof.

In an aspect of the disclosure, the reference transfer position is a position in which a preset reference engagement hole provided at a downstream side in a transfer direction rather than the printing start position of the next page reaches the printing position, and the distance between the reference engagement hole and the printing start position of the next page is set as the target feeding amount. For the continuous paper with the engagement holes formed along the longitudinal direction and page divisions, such as cut holes, provided at regular intervals, the cut holes (page division) and the engagement holes have a constant position relation in the product. The distance from each engagement hole to the printing start position of the next page is accurately determined in advance. Accordingly, when the preset reference engagement hole (e.g., engagement hole just before the cut hole, or engagement hole located at a downstream side by the predetermined number from the cut hole) passes through the printing position, this is detected on the basis of the detected value of the tractor feeding amount detecting unit, and then the distance between the reference engagement hole previously stored and the printing start position of the next page is set as the target feeding amount. Therefore, the continuous paper can be transferred with high precision by the simple control.

According to another aspect of the disclosure, a printer includes a printing head, a tractor that has a sequential engagement portion which is engaged with engagement holes formed along a longitudinal direction of continuous paper, of which page dividing positions are set at regular intervals, the tractor transferring the continuous paper along a transfer path which passes through a printing position of the printing head, a tractor feeding amount detecting unit that detects a feeding amount of the tractor, a paper feed roller that is provided at a downstream side in a transfer direction of the tractor, a roller feeding amount detecting unit that detects a rotational amount of the paper feed roller, a printing control unit that performs printing on each page of the continuous paper transferred by a transferring force of the paper feed roller using the printing head, and a cueing control unit that transfers the continuous paper until a printing start position of a next page reaches the printing position, when printing of each page is completed. The cueing control unit transfers the continuous paper until the continuous paper reaches a reference transfer position at which a distance between the printing start position of the next page and the printing position is equal to a reference dimension based on a detected value from the tractor feeding amount detecting unit. After the continuous paper reaches the reference transfer position, sets the transfer amount of the continuous paper with which the printing start position of the next page reaches the printing position from the reference transfer position as a target feeding amount.

As described above, an aspect of the disclosure performs the high precise printing by transferring the continuous paper with the transfer precision of the paper feed roller during printing of each page, based on the detected value from the roller feeding amount detecting unit. Meanwhile, in the cueing process of positioning the printing start position of the next page at the printing position, the continuous paper is transferred to the preset reference transfer position using the detected value from the tractor feeding amount detecting unit, and at this point, the target feeding amount in the remaining transfer section is reset. Therefore, the target feeding amount in the remaining transfer section can be accurately set when the printing start position of the next page is sufficiently close to the printing position. Therefore, since the printing start position shift can be reduced, it is possible to prevent the accumulation in the transfer error occurring at each page. In addition, it is preferable to detect the reach of the continuous paper to the preset reference transfer position using the tractor feeding amount detecting unit, and to set the target transfer amount from that point as the determined value. Accordingly, the control is easy.

In an aspect of the disclosure, the cueing control unit controls the transfer amount of the continuous paper in the remaining transfer section, based on the detected value from the tractor feeding amount detecting unit. In this way, the transfer error caused by the slip of the paper feed roller in the remaining transfer section is not added.

Alternatively, in an aspect of the disclosure, the cueing control unit may control the transfer of the set target feeding amount based on a detected value from the roller feeding amount detecting unit. In this way, it is possible to perform the transfer in the remaining transfer section with the feed precision of the paper feed roller. Further, in this instance, it is preferable that after the transfer of the continuous paper in the remaining transfer section is performed based on the set target feeding amount, the cueing control unit calculates an actual feeding amount of the continuous paper in the remaining transfer section based on the detected value from the tractor feeding amount detecting unit, and calculates a difference between the actual feeding amount and the target feeding amount, and in a next cueing process, the target feeding amount is compensated to eliminate the difference. In this way, since a slight transfer error occurring in the remaining transfer section can be figured out, and then be eliminated at the next page, it is possible to reduce the transfer error in the remaining transfer section, and to prevent the accumulation thereof.

In an aspect of the disclosure, the reference transfer position is a position in which a preset reference engagement hole provided at a downstream side in a transfer direction rather than the printing start position of the next page reaches the printing position, and the cueing control unit sets the distance between the reference engagement hole and the printing start position of the next page as the target feeding amount. In this way, using the fact that the cut holes (page division) and the engagement holes have a constant position relation in the product, a transfer position of a specific engagement hole may be figured out based on the detected value of the tractor feeding amount detecting unit, and then the distance between the engagement hole previously stored and the printing start position of the next page is set as the target feeding amount. Therefore, the continuous paper can be transferred with high precision by the simple control.

According to an aspect of the disclosure, the continuous paper is transferred with the transfer precision of the paper feed roller on the basis of the detected value from the roller feeding amount detecting unit, thereby performing the high precise printing. Also, after the printing is completed, the control of the feeding amount and the set of the target feeding amount are performed by use of the detected value from the tractor feeding amount detecting unit. Therefore, it is possible to prevent accumulation in the transfer errors which are created from each page, and to decrease the printing start position shift.

DESCRIPTION OF EXEMPLARY EMBODIMENTS

Now, an embodiment of a printer and a transfer control method of continuous paper according to an aspect of the disclosure will be described with reference to the accompanying drawings.

Overall Configuration

Figure 1A:
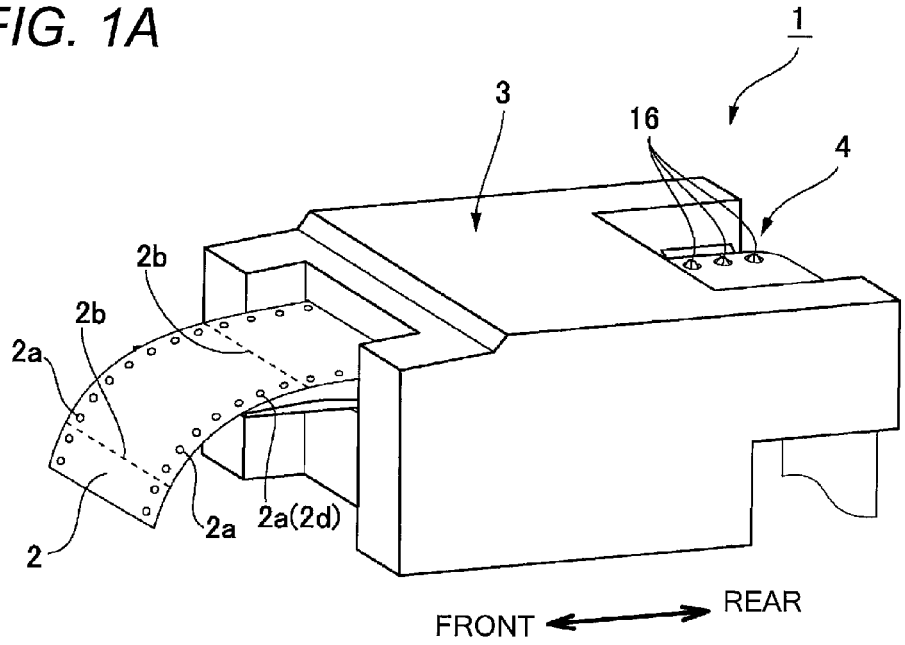
FIG. 1A is a perspective view of a printer.
Figure 1B:
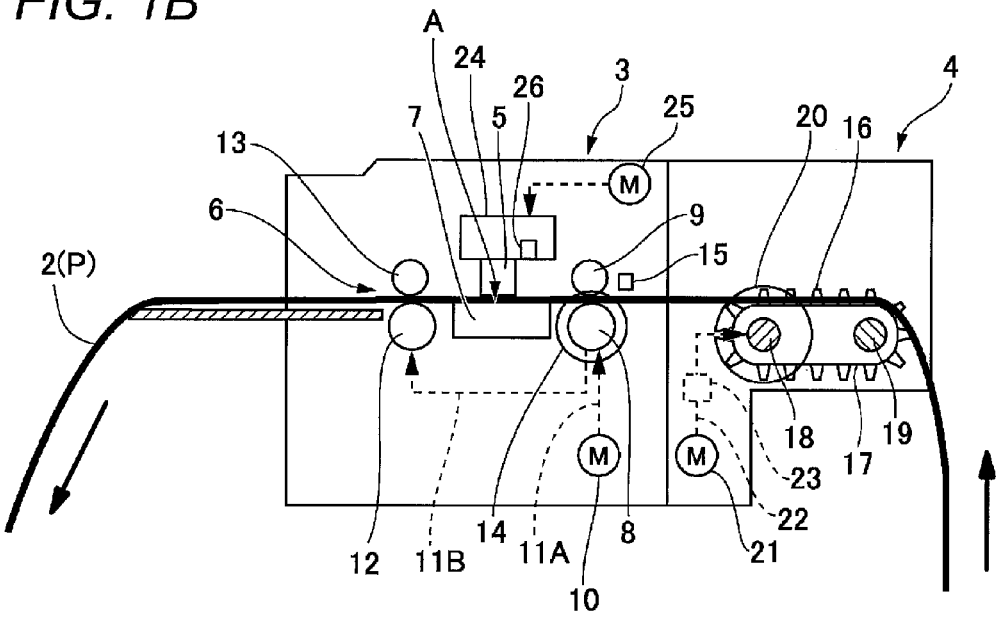
FIG. 1B is a longitudinal cross-sectional view schematically illustrating major parts of the printer.

FIG. 1A is a perspective view of a printer, and FIG. 1B is a longitudinal cross-sectional view schematically illustrating major parts of the printer. A printer 1 is configured to print continuous paper 2 (recording medium) with sprocket holes (engagement holes) 2*a* formed at both end portions thereof along a paper width direction. The printer 1 includes a printer body 3 and a tractor 4 detachably mounted to a rear portion of the printer body 3 in a front-rear direction of the printer. The continuous paper 2 is conveyed from a rear side of the printer into the printer body 3 by the tractor 4, and then is discharged to a front side of the printer from the printer body 3 after printing is performed.

In the printer body 3, a transfer path P is set in a straight type in the front-rear direction of the printer via a printing position A, in which the continuous paper 2 is printed by a printing head 5, and a paper transfer passage 6 for transferring the continuous paper 2 along the transfer path P is formed. The printing position A is defined by a platen 7 which is disposed below the paper transfer passage 6, and the printing head 5 is disposed at a position opposite to the platen 7.

A paper feed roller 8 is disposed between the printing position A and the tractor 4 to feed the continuous paper 2 to the printing position A. A paper feed/press roller is disposed above the paper feed roller 8. The paper feed/press roller 9 is biased in a downward direction by a pressing unit (not illustrated), and thus abuts against the paper feed roller 8 from an upper side by a desired biasing force. Further, a paper discharge roller 12 for discharging the printed continuous paper 2 is disposed at the front side of the printer (downstream in a paper feed direction) rather than the printing position A. A paper press roller 13 is disposed above the paper discharge roller 12. The paper feed/press roller 13 is biased in the downward direction by a pressing unit (not illustrated), and abuts against the paper discharge roller 12 from the upper side by a desired pressing force.

A driving force is transmitted to the paper feed roller 8 from a paper feed motor 10 via a first driving force transmitting mechanism 11A consisting of a gear train, as denoted by a dotted line in FIG. 10B. The paper feed motor 10 is mounted on the printer body 3. Further, the driving force transmitted to the paper feed roller 8 from the paper feed motor 10 is transmitted to the paper discharge roller 12 via a second driving force transmitting mechanism 11B consisting of a gear train. A roller encoder 14 (roller feeding amount detecting unit) for detecting a rotational amount of the paper feed roller 8 is mounted on a rotation shaft of the paper feed roller 8. In this instance, the roller encoder 14 may be attached to a rotation shaft which rotates in unison with one of gears constructing the first driving force transmitting mechanism 11A.

Between the paper feed roller 8 and the tractor 4, a paper detector 15 is provided at a position, at the rear side of the printer (upstream in the paper feed direction), adjacent to the paper feed roller 8. The paper detector 15 is, for example, a reflection type photosensor, and detects the continuous paper 2 which is transferred to the paper transfer passage 6 by the tractor 4.

The tractor 4 includes tractor pins (engagement portions) 16 which can be inserted into the sprocket holes 2*a* of the continuous paper 2, a tractor belt 17 with the tractor pins 16 formed on its outer circumference at regular intervals, and a drive sprocket 18 and a driven sprocket 19 with the tractor belt 17 mounted therebetween. The drive sprocket 18 is provided with a tractor encoder 20 (tractor feeding amount detecting unit) for detecting a rotational amount of the drive sprocket 18. In this instance, the tractor encoder 20 may be mounted on the driven sprocket 19.

The tractor 4 is provided with a tractor drive motor 21. A driving force is transmitted to the drive sprocket 18 from the tractor drive motor 21 via a third driving force transmitting mechanism 22. The third driving force transmitting mechanism 22 includes a clutch mechanism 23, and the clutch mechanism 23 is configured to interrupt or connect the transmission path of the driving force between the tractor drive motor 21 and the tractor 4.

When the continuous paper 2 is transferred by the tractor 4, the continuous paper 2 is set so that the tractor pins 16 are inserted into the sprocket holes 2*a*. After that, the drive sprocket 18 is rotated by the driving force of the tractor drive motor 21 to rotate the tractor belt 17. Accordingly, the tractor pins 16 are sequentially engaged with the sprocket holes 2*a* to continuously transfer the continuous paper 2.

The printing head 5 is an inkjet head, and is mounted on a carriage 24 which is disposed above the paper transfer passage 6. The carriage 24 holds the printing head 5 at a position between the plate 7 and the printing head 5. The carriage 24 is able to reciprocate in a scanning direction perpendicular to the paper feed direction by the driving force of the carriage motor 25.

The carriage 24 is provided with a paper width detector 26. The paper width detector 26 is, for example, a reflection type photosensor which is installed at a portion of the carriage 24 facing the platen 7. The paper width detector 26 irradiates an inspection light toward the platen 7, and then detects a reflected light from the platen 7 or the continuous paper 2 transferred on the platen 7. It is possible to detect a left end and a right end of the continuous paper 2 by the paper width detector 26 which is operated in conjunction with the movement of the carriage 24 in a direction perpendicular to the paper feed direction. On the basis of the detected result, the paper width of the continuous paper 2 can be detected, and simultaneously, a passing position of the continuous paper 2 in the direction perpendicular to the paper feed direction (transfer direction) can be detected.

Continuous Paper

Figure 2:
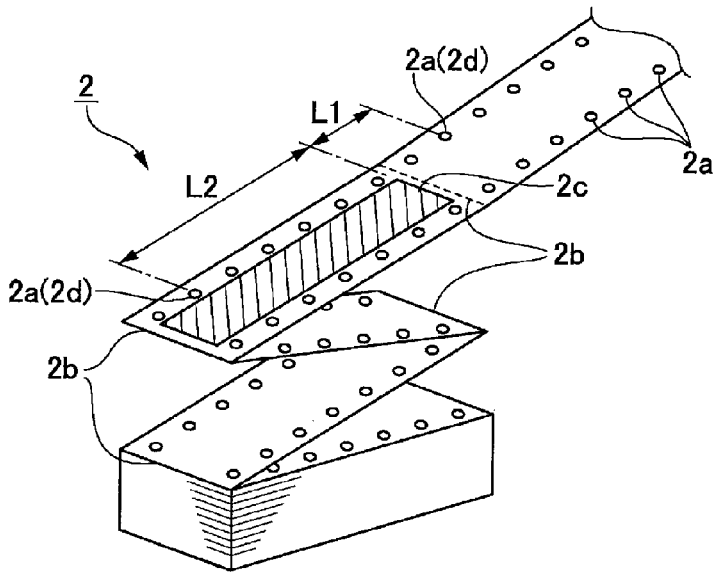
FIG. 2 is an explanatory view of continuous paper.

FIG. 2 is an explanatory view of the continuous paper 2. Page break positions are set on the continuous paper 2 at regular intervals in the longitudinal direction thereof, and cut holes 2*b* are formed at each page break position. The continuous paper 2 is bent to alternatively form ridge folds and valley folds in its longitudinal direction at the position of the cut holes 2*b*, and is folded in a shape of a booklet-like bunch. As the end portion of the continuous paper 2 drawn from the uppermost surface of the bunch is loaded on the printer 1, and then the continuous paper 2 is sequentially drawn from the folded uppermost layer, the continuous paper 2 is fed to the printer 1. A stylized printed matter can be issued by performing the printing on each page of the continuous paper 2 which is divided by the cut holes 2*b* and then cutting the continuous paper 2 at the cut holes 2*b* after printing. A margin of a constant length is provided between a printing start position 2*c* and the cut holes 2*b* of each page.

The sprocket holes 2*a* are arranged at regular pitches in its longitudinal direction at both end portions of the continuous paper 2 in the paper width direction. The sprocket holes 2*a* of each page are disposed in a constant position relation with the cut holes 2*b* which are disposed at the leading and trailing ends of each page. In this embodiment, the sprocket hole 2*a* disposed at the second position when counting it from the cut hole 2*b* of the trailing end of each page to the leading end of the page (i.e., downstream side in the transfer direction) is regarded as a reference sprocket hole 2*c* (reference engagement hole) in a cueing process which will be described later. A distance L1 from the reference sprocket hole 2*d* to the printing start position 2*c* of the next page, and a distance L2 from the reference sprocket hole 2*d* and the printing start position 2*c* of the same page are the same dimension for all page.

Control System

Figure 3:
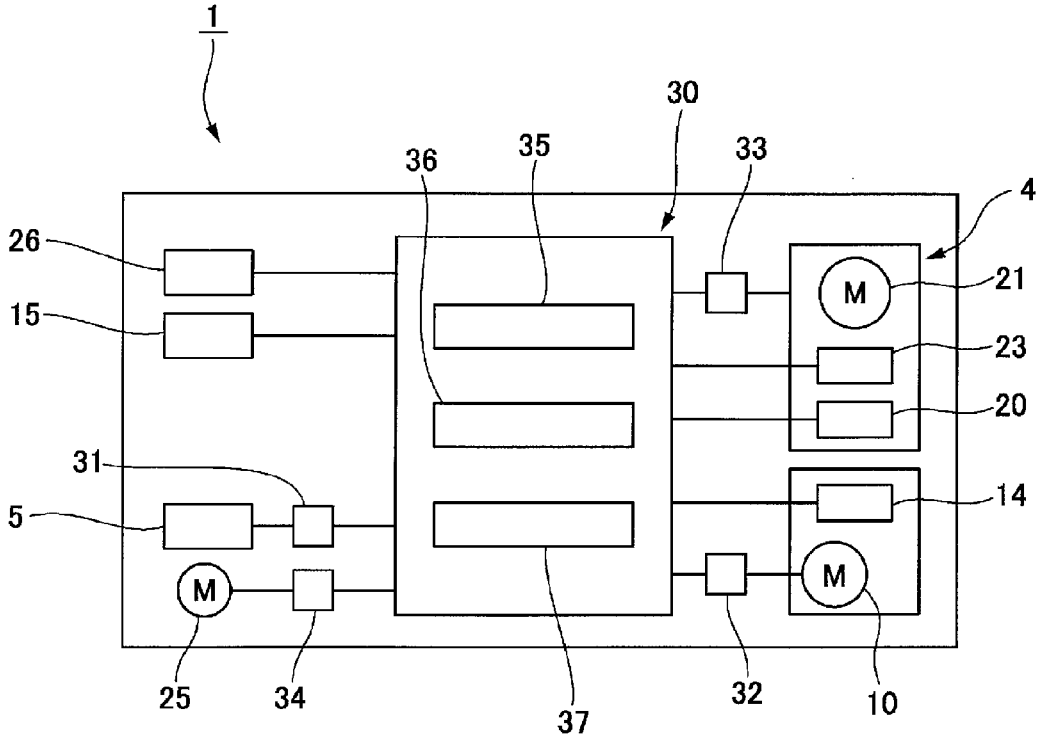
FIG. 3 is a block diagram schematically illustrating a control system of the printer.

FIG. 3 is a block diagram schematically illustrating the control system of the printer 1. The control system of the printer 1 is mainly configured of a control unit 30 having a CPU, a ROM, and a RAM. The control unit 30 is input by a printing command from an external appliance (not illustrated), or the detected values from the paper detector 15, the paper width detector 26, the roller encoder 14, and the tractor encoder 20. The printing head 5 is connected to the output side of the control unit 30 via the head driver 31. Further, the control unit 30 is connected to the paper feed motor 10 via a first motor driver 32, is connected to the tractor drive motor 21 via a second motor driver 33, and is connected to the carriage motor 25 via a third motor driver 34.

The control unit 30 includes a tractor drive control portion 35, a printing control portion 36, and a cueing control portion 37. If the control unit 30 receives the printing command, the tractor drive control portion 35 controls the driving of the tractor drive motor 21 to drive the tractor 4 and thereby to transfer the set continuous paper 2 to the tractor 4. Further, if the leading end of the continuous paper 2 is detected by the paper detector 15, the tractor drive control portion 35 transfers the continuous paper 2 by a predetermined feeding amount by use of the tractor 4, so that the leading end of the continuous paper 2 is inserted into a nip portion between the paper feed roller 8 and the paper feed/press roller 9. Subsequently, the driving of the tractor 4 is stopped, and simultaneously, the clutch mechanism 23 is controlled to interrupt the transmission path of the driving force between the tractor drive motor 21 and the tractor 4. If the transmission path is interrupted, the tractor 4 is driven by following the transfer of the continuous paper 2 which is caused by the paper feed roller 8.

Based on the detection of the leading end of the continuous paper 2 by the paper detector 15, the printing control system 36 drives the paper feed motor 10 to start rotation of the paper feed roller 8, and thus the delivery of the continuous paper 2 from the tractor 4 is executed. Further, if the transfer of the tractor 4 is stopped, the continuous paper 2 is transferred by the paper feed roller, and then the printing start position 2*c* of the initial page is determined at the printing position A. Subsequently, in conjunction with the transfer operation of the continuous paper 2 by the transfer force of the paper feed roller 8, the driving of the carriage motor 25 and the discharge of the ink by the printing head 5 are controlled to perform the printing of the continuous paper 2. The printing control portion 36 controls the transfer amount of the continuous paper 2 based on the detected value from the roller encoder 14.

If the printing corresponding to one page by the printing control portion 36 is completed, the cueing control portion 37 continuously transfers the continuous paper 2 using the paper feed roller to feed the continuous paper 2 to the next page, and performs the cueing to transfer the continuous paper 2 until the printing start position 2*c* of the next page is determined at the printing position A. If the cueing starts, the cueing control portion 37 first monitors the transfer position of the continuous paper 2 based on the detected value from the tractor encoder 20, and then transfers the continuous paper 2 until the reference sprocket hole 2*d* disposed at the second position when counting from the trailing end of the page toward the leading end of the page reaches the printing position A. Further, the cueing control portion 37 sets the target feeding amount for the remaining transfer section until the printing start position 2*c* of the next page reaches the printing position A. After that, the continuous paper 2 is transferred according to the set target feeding amount.

As described above, the distance from the reference sprocket hole 2*d* to the printing start position 2*c* of the next page is L1 for every page. In this embodiment, the distance L1 (reference dimension) is stored in the cueing control portion 37. The cueing control portion 37 transfers the continuous paper 2 until the reference sprocket hole 2*d* reaches the printing position A, that is, the continuous page 2 reaches the reference transfer position in which the distance L1 between the printing position A and the printing start position 2*c* of the next page is L1. The value of L1 in the second process is read, and then the target feeding amount is set as L1.

The detected value form the tractor encoder 20 is reflected by the movement amount of the tractor pin 16 engaged with the sprocket hole 2*a*. The movement amount of the tractor pin 16 is reflected by the actual feeding amount of the continuous paper 2 although there is an error within a play range between the sprocket hole 2*a* and the tractor pin 16. Accordingly, it is possible to calculate the actual feeding amount of the continuous paper 2 based on the detected value of the tractor encoder 20, irrespective of whether the tractor 4 is the main feeding unit or not. The cueing control portion 37 calculates the actual feeding amount from the printing start time of each page based on the detected value from the tractor encoder 20, thereby monitoring the transfer position of the continuous paper 2. When the calculated actual feeding amount is equal to the above-described distance L2 (the distance from the printing start position 2*c* of the leading end of the page to the reference sprocket hole 2*d* of the trailing end of the same page), the cueing control portion 37 determines that the reference sprocket hole 2*d* reaches the printing position A.

The cueing control portion 37 controls the transfer amount of the continuous paper 2 based on the detected value from the tractor encoder 20, when the continuous paper 2 is transferred to the reference transfer position. Further, even when the continuous paper is transferred by the target feeding amount in the remaining transfer section after it reaches the reference transfer position, the cueing control portion 37 controls the transfer amount of the continuous paper 2 based on the detected value from the tractor encoder 20.

Printing Operation

Figure 4:
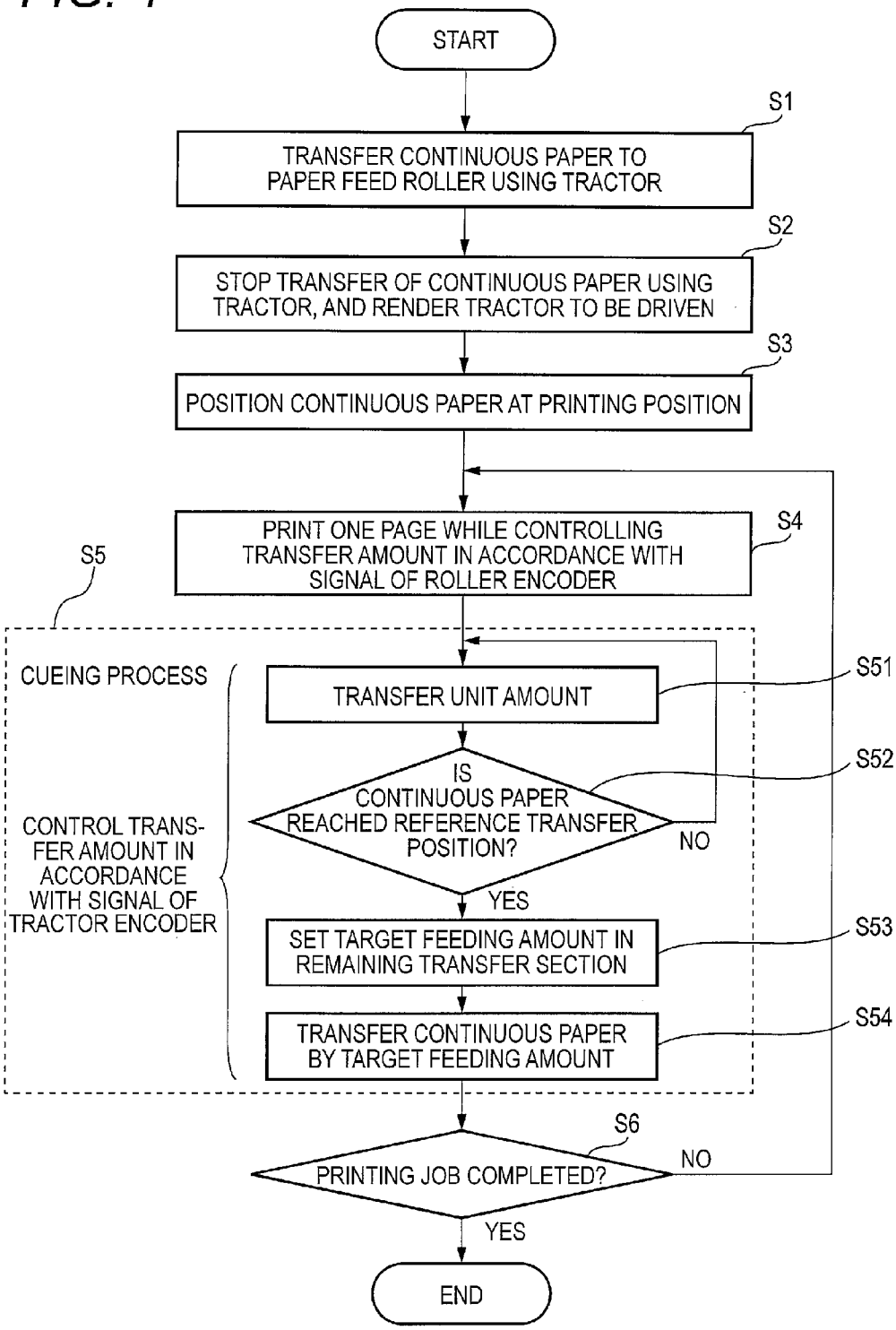
FIG. 4 is a flowchart illustrating a printing operation of the continuous paper.

FIG. 4 is a flowchart illustrating the printing operation of the continuous paper 2. If the control unit 30 of the printer 1 receives the printing command from the external appliance, it starts the process of step S1. In step S1, the tractor drive control portion 35 transfers the continuous paper 2 using the tractor 4 to deliver it to the paper feed roller 8. That is, the tractor 4 is driven, and the continuous paper 2 set in the tractor 4 is fed to the paper transfer passage 6. After that, if the leading end of the continuous paper 2 is detected by the paper detector 15, the tractor drive control portion 35 transfers the continuous paper 2 by the predetermined feeding amount using the tractor 4 to insert the leading end of the continuous paper 2 into the nip portion between the paper feed roller 8 and the paper feed/press roller 9. And, it proceeds to step S2.

In step S2, the tractor drive control portion 35 stops the driving of the tractor 4, and controls the clutch mechanism 23 to interrupt the transmission path of the driving force between the tractor drive motor 21 and the tractor 4, so that the tractor 4 is in the state which can be driven by the transfer of the continuous paper 2 caused by the paper feed roller 8.

In step S3, the printing control portion 36 starts the transfer of the continuous paper 2 by the transfer force of the paper feed roller 8 to determine the continuous paper 2 at the printing position A. Subsequently, the printing control portion 36 performs the printing corresponding to one page. That is, in conjunction with the transfer operation of the continuous paper 2 by the transfer force of the paper feed roller 8, the printing control portion 36 controls the driving of the carriage motor 25 and the discharge of the ink by the printing head 5 to perform the printing of the continuous paper 2. In step S4, the printing control portion 36 controls the transfer amount of the continuous paper 2 based on the detected value from the roller encoder 14. If the printing corresponding to one page is completed, it proceeds to step S5.

In step S5, the cueing control portion 37 transfers the continuous paper 2 using the paper feed roller, and controls the transfer amount of the continuous paper 2 based on the detected value from the tractor encoder 20. Simultaneously, the cueing control portion 37 performs the cueing to transfer the continuous paper 2 until the printing start position 2*c* of the next page reaches the printing position A.

In step S5, whenever the continuous paper 2 is transferred by a unit amount by the paper feed roller (step S51), it is determined based on the detected value from the tractor encoder 20 whether or not the actual feeding amount L2 is achieved, in other words, the continuous paper 2 reaches the reference transfer position (step S52). If the actual feeding amount L2 is achieved (Yes in step S52), it proceeds to step S53, and the target feeding amount of the remaining transfer section is set as L1. Subsequently, it proceeds to step S54, and while the transfer amount of the continuous paper 2 is controlled based on the detected value from the tractor encoder 20, the continuous paper 2 is transferred by the target feeding amount L1. It proceeds to step S6.

In step S6, the cueing control portion 37 determines whether a printing job is completed or not. That is, it is determined whether the printing of the finale page is completed or not, and if the printing is completed (Yes in step S6), the process is completed. Meanwhile, if the printing job is remained (No in step S6), it returns to step S4, and steps S4 and S5 are repeated until the printing job is completed.

As described above, the printer 1 according to this embodiment can perform the high precise printing by transferring the continuous paper 2 with the transfer precision of the paper feed roller 8 during printing of each page. Meanwhile, in the cueing process of positioning the printing start position 2*c* of the next page at the printing position A after the printing is completed, the continuous paper 2 is transferred until the printing start position 2*c* of the next page is sufficiently close to the printing position A, specifically, the reference sprocket hole 2*d* sufficiently close to the printing start position 2*c* of the next page reaches the printing position A, based on the detected value from the tractor encoder 20. At this point, the target feeding amount in the remaining transfer section is again set as the accurate value L1. If the feeding amount is controlled using the detected value from the tractor encoder 20, as described above, a transfer error is not accumulated even though the feeding amount is increased. Accordingly, the accurate target feeding amount is set at the point, in which the remaining transfer amount is small, in the cueing process based on the detected value from the tractor encoder 20. Therefore, even though a shift is caused by slip during printing, it is possible to eliminate the shift, and the transfer errors are not accumulated from the previous pages. In addition, since the control is performed based on the detected value from the tractor encoder 20 in the final remaining transfer section, it is possible to prevent the transfer error from occurring in the remaining transfer section. In this embodiment, since the control based on the detected value from the roller encoder 14 and the control based on the detected value from the tractor encoder 20 are properly combined, it is possible to have a good balance between high precise printing and prevention of accumulated transfer shift with simple control.

Modification

Although the transfer control method of the above-described embodiment controls the transfer amount based on the detected value from the tractor encoder 20 in the remaining transfer section immediately before the cueing process is completed, a transfer control method of the modification performs the control of the feeding amount in the remaining transfer section based on the detected value from the roller encoder 14, and simultaneously, calculating the feed error in the remaining transfer section, thereby compensating a target feeding amount to eliminate the error in the next page.

Figure 5:
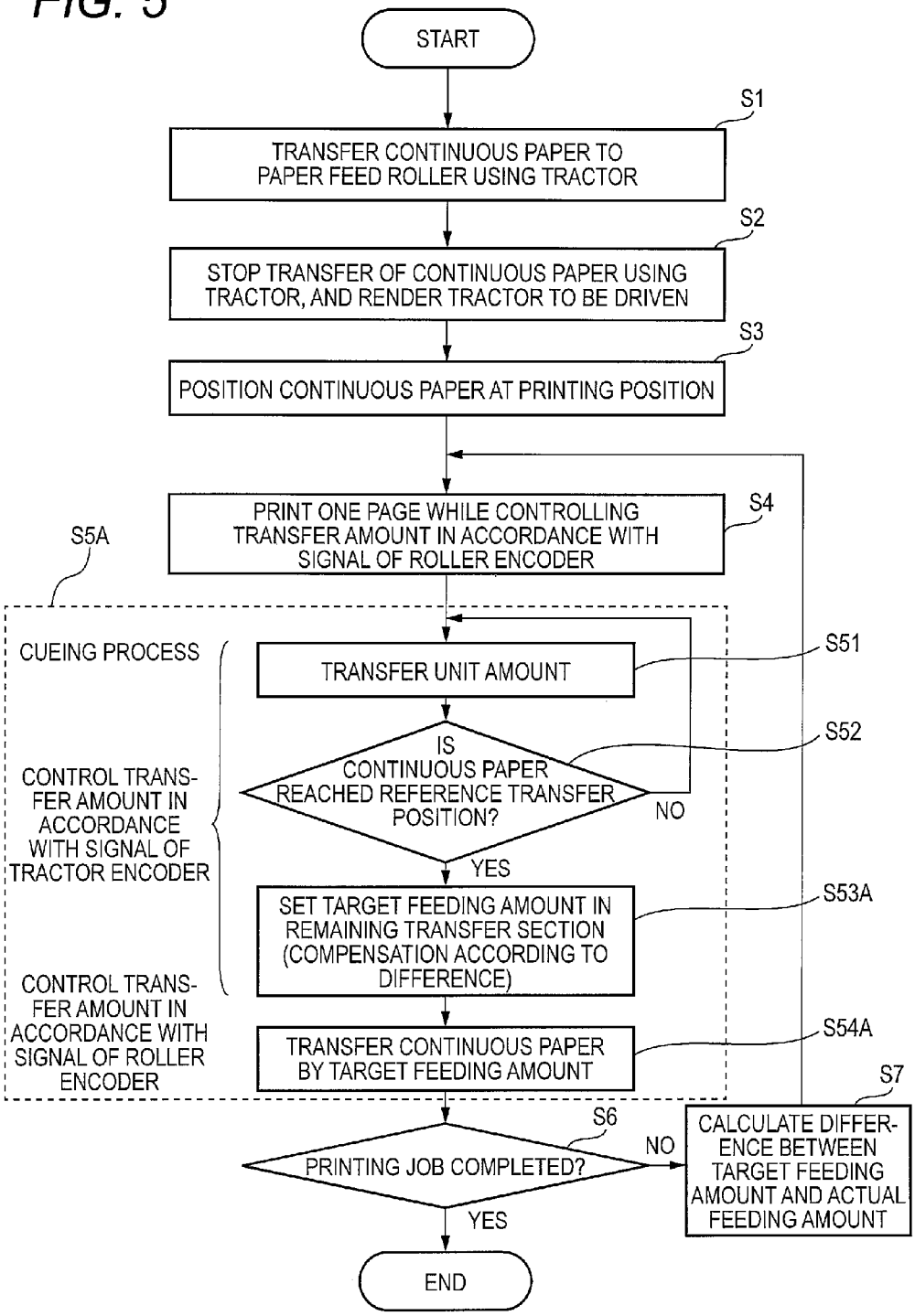
FIG. 5 is a flowchart illustrating a printing operation of a continuous paper according to a modification.

FIG. 5 is a flowchart illustrating the printing operation of the continuous paper 2 according to the modification. The processes of steps S1 to S4 and S6 in the modification are equal to those of the above embodiment. In the cueing process (step S5A), the cueing control portion 37 controls the transfer amount of the continuous paper 2 based on the detected value from the roller encoder 14, and performs the process of transferring the continuous paper 2 by the target feeding amount L1 (step S54A), instead of step S54.

In this modification, if the printing job is remained in step S6 (No in step S6), it returns to step S4 via step S7. In step S7, the actual feeding amount in the remaining transfer section is calculated based on the detected value from the tractor encoder 20, and a difference between the target feeding amount L1 which is the set feeding amount and the actual feeding amount is calculated. The cueing control portion 37 stores the calculated difference therein, and compensates the target feeding amount to eliminate the calculated difference in a process (step S53A) of setting the target feeding amount of the remaining transfer section at the time of the next cueing process. For example, if the target feeding amount is L1 and the actual feeding amount is less than L1, the compensation is performed by adding the difference to the target feeding amount L1. In this way, if the transfer error occurs while the continuous paper is transferred with the transfer precision of the paper feed roller in the remaining transfer section, the transfer error can be eliminated in the next page. Therefore, it is possible to prevent the accumulation in the transfer error.

What is claimed is:

1. A transfer control method of continuous paper in a printer including a tractor that is driven by a tractor driving source and has a sequential engagement portion which is engaged with engagement holes formed along a longitudinal direction of the continuous paper in which page dividing positions are set at regular intervals, and a paper feed roller that is driven by a roller driving source which is independent of the tractor driving source and is provided at a downstream side in a transfer direction of the tractor, the printer transferring the continuous paper using the paper feed roller and the tractor through a printing position of a printing head, the transfer control method comprising:

controlling a transfer amount of the continuous paper based on a rotational amount detected by a roller feeding amount detecting unit which is disposed on the paper feed roller and detects the rotational amount of the paper feed roller, when each page of the continuous paper is printed; and when printing on each page is completed, performing a cueing process of transferring the continuous paper until a printing start position of a next page reaches the printing position;

wherein the cueing process includes:

transferring the continuous paper until the continuous paper reaches a reference transfer position at which a distance between the printing start position of the next page and the printing position is equal to a reference dimension based on the feeding amount of the tractor detected by a tractor feeding amount detecting unit for detecting a feeding amount of the tractor, the tractor feeding amount detecting unit being disposed on the tractor, and after the continuous paper reaches the reference transfer position, setting the transfer amount of the continuous paper with which the printing start position of the next page reaches the printing position from the reference transfer position as a target feeding amount.

2. The transfer control method of the continuous paper according to claim 1, wherein the transfer of the set target feeding amount is controlled based on a detected value from the tractor feeding amount detecting unit.

3. The transfer control method of the continuous paper according to claim 1, wherein the transfer of the set target feeding amount is controlled based on a detected value from the roller feeding amount detecting unit.

4. The transfer control method of the continuous paper according to claim 3, wherein after the transfer of the continuous paper in the remaining transfer section is performed based on the set target feeding amount, the actual feeding amount of the continuous paper in the remaining transfer section is calculated based on the detected value from the tractor feeding amount detecting unit, and a difference between the actual feeding amount and the target feeding amount is calculated, and in a next cueing process, the target feeding amount is compensated to eliminate the difference.

5. The transfer control method of the continuous paper according to claim 1, wherein the reference transfer position is a position at which a preset reference engagement hole provided at a downstream side in a transfer direction rather than the printing start position of the next page reaches the printing position, and the distance between the reference engagement hole and the printing start position of the next page is set as the target feeding amount.

6. The transfer control method of the continuous paper according to claim 1, wherein the roller feeding amount detecting unit comprises a roller encoder.

7. A printer comprising:

a printing head;

a tractor that is driven by a tractor driving source and has a sequential engagement portion which is engaged with engagement holes formed along a longitudinal direction of continuous paper, of which page dividing positions are set at regular intervals, the tractor transferring the continuous paper along a transfer path which passes through a printing position of the printing head;

a tractor feeding amount detecting unit that is disposed on the tractor and detects a feeding amount of the tractor;

a paper feed roller that is driven by a roller driving source which is independent of the tractor driving source and is provided at a downstream side in a transfer direction of the tractor;

a roller feeding amount detecting unit that is disposed on the paper feed roller and detects a rotational amount of the paper feed roller;

a printing control unit that performs printing on each page of the continuous paper transferred by a transferring force of the paper feed roller using the printing head; and a cueing control unit that transfers the continuous paper until a printing start position of a next page reaches the printing position, when printing of each page is completed, wherein the cueing control unit transfers the continuous paper until the continuous paper reaches a reference transfer position at which a distance between the printing start position of the next page and the printing position is equal to a reference dimension based on a detected value from the tractor feeding amount detecting unit, and after the continuous paper reaches the reference transfer position, sets the transfer amount of the continuous paper with which the printing start position of the next page reaches the printing position from the reference transfer position as a target feeding amount.

8. The printer according to claim 7, wherein the cueing control unit controls the transfer of the set target feeding amount based on the detected value from the tractor feeding amount detecting unit.

9. The printer according to claim 7, wherein the cueing control unit controls the transfer of the set target feeding amount based on a detected value from the roller feeding amount detecting unit.

10. The printer according to claim 9, wherein after the transfer of the continuous paper in the remaining transfer section is performed based on the set target feeding amount, the cueing control unit calculates an actual feeding amount of the continuous paper in the remaining transfer section based on the detected value from the tractor feeding amount detecting unit, and calculates a difference between the actual feeding amount and the target feeding amount, and in a next cueing process, the target feeding amount is compensated to eliminate the difference.

11. The printer according to claim 7, wherein the reference transfer position is a position in which a preset reference engagement hole provided at a downstream side in a transfer direction rather than the printing start position of the next page reaches the printing position, and the cueing control unit sets the distance between the reference engagement hole and the printing start position of the next page as the target feeding amount.

12. The printer according to claim 7, wherein the roller feeding amount detecting unit comprises a roller encoder.

13. A transfer control method of continuous paper in a printer including a tractor that is driven by a tractor driving source and has a sequential engagement portion which is engaged with engagement holes formed along a longitudinal direction of the continuous paper in which page dividing positions are set at regular intervals, and a paper feed roller that is driven by a roller driving source which is separate from the tractor driving source and is provided at a downstream side in a transfer direction of the tractor, the printer transferring the continuous paper using the paper feed roller and the tractor through a printing position of a printing head, the transfer control method comprising:

controlling a transfer amount of the continuous paper based on a rotational amount detected by a roller feeding amount detecting unit which is disposed on the paper feed roller and detects the rotational amount of the paper feed roller, when each page of the continuous paper is printed; and when printing on each page is completed, performing a cueing process of transferring the continuous paper until a printing start position of a next page reaches the printing position;

wherein the cueing process includes:

transferring the continuous paper until the continuous paper reaches a reference transfer position at which a distance between the printing start position of the next page and the printing position is equal to a reference dimension based on the feeding amount of the tractor detected by a tractor feeding amount detecting unit for detecting a feeding amount of the tractor, the tractor feeding amount detecting unit being disposed on the tractor, and after the continuous paper reaches the reference transfer position, setting the transfer amount of the continuous paper with which the printing start position of the next page reaches the printing position from the reference transfer position as a target feeding amount.

* * * * *